United States Patent [19]

Isarai et al.

[11] 4,305,979

[45] Dec. 15, 1981

[54] PROCESS FOR CURING COATED FILM

[75] Inventors: Takayuki Isarai; Tukasa Hanada, both of Tokyo, Japan

[73] Assignee: Kansai Paint Co., Ltd., Japan

[21] Appl. No.: 108,786

[22] Filed: Dec. 31, 1979

[30] Foreign Application Priority Data

Feb. 15, 1979 [JP] Japan ..... 54-15428

[51] Int. Cl.[3] ..... B05D 3/02

[52] U.S. Cl. ..... 427/386; 427/387; 427/388.1; 427/388.3; 427/388.4; 427/406; 427/409; 427/410

[58] Field of Search ..... 427/344, 388.1, 388.3, 427/336, 406, 419.8, 340, 333, 407.1, 386, 409, 410; 106/14.21, 14.44, 306, 292, 1.17, 287.16; 252/387

[56] References Cited

U.S. PATENT DOCUMENTS

| | | | |
|---|---|---|---|
| 2,944,919 | 7/1960 | Morris et al. | 106/14.21 X |
| 2,968,571 | 1/1961 | Lantz | 106/287.16 X |
| 3,202,531 | 8/1965 | Dowd | 427/344 |
| 3,634,109 | 1/1972 | Mago | 106/287.16 X |
| 3,977,888 | 8/1976 | Sano et al. | 427/344 X |
| 4,110,117 | 8/1978 | McLeod | 106/1.17 |
| 4,150,191 | 4/1979 | Karki | 427/344 X |
| 4,229,495 | 10/1980 | Takahashi et al. | 428/36 |

*Primary Examiner*—Michael R. Lusignan
*Assistant Examiner*—Thurman K. Page
*Attorney, Agent, or Firm*—Wenderoth, Lind & Ponack

[57] ABSTRACT

A process for curing a coated film of an alkyl silicate type zinc rich paint, which comprises coating a substrate with an alkyl silicate type zinc rich paint, and then treating the resulting coated film with an aqueous liquid containing a basic substance, thereby to promote the curing of the coated film.

10 Claims, No Drawings

PROCESS FOR CURING COATED FILM

This invention relates to a process for curing a coated film, and more specifically, to a process for promoting the curing of a coated film of an alkyl silicate type zinc rich paint.

An alkyl silicate type zinc rich paint is basically a paint comprising three components, an alkyl silicate (a silicic acid alkyl ester), zinc powder and a solvent (usually, an alcohol, ether or ester type solvent), said zinc powder being contained in a high concentration of 60 to 95% by weight based on a dry film basis. The alkyl silicate contained in the coated film that has been formed from said paint forms a silanol upon hydrolysis under the action of water, at least part of said silanol turns into a polysiloxane upon mutual dehydrocondensation, and said silanol and/or said polysiloxane reacts with the zinc powder present to cause a three-dimensional curing. The alkyl silicate type zinc rich paint has excellent corrosion preventive effect and finds use as a maintenance-free heavy-duty corrosion-preventive paint for large-sized steel structures such as ship and marine structures. In fields such as marine containers and industrial machinery, as well, there has been the recent trend to use alkyl silicate type zinc rich paints. The alkyl silicate type zinc rich paints, however, are seriously defective in that they cannot be utilized on a continuous mass-production line system, because their coatings require a long time (usually, about 24 to 48 hours at ordinary temperatures) to cure.

Alkyl silicate type zinc rich paints, moreover, contain zinc powder in a high concentration as aforementioned, and after formation of coatings, cause shrinkage to the coatings due to dehydrocondensation during the curing of the coatings. Therefore, when the thickness of the coated film is large, e.g. about 140μ or more (dry film thickness), cracks occur in the coated film, and the time required for the coated film to dry and cure markedly lengthens. The coated film of the alkyl silicate type zinc rich paint, furthermore, has the tendency to become porous during its curing owing to hydrogen gas generated by the reaction of zinc powder with the silanol formed by the hydrolysis of the alkyl silicate and/or the polysiloxane that is the condensate of the silanol. Applying onto such coated film a top coat paint such as an epoxy paint, an epoxy tar paint or a chlorinated rubber paint poses the problem that drawbacks such as pinholes, craters or rough surface arise in the top coat. To prevent these drawbacks, the so-called mist coating of a top coat paint has been adopted in which the top coat paint is coated thinly many times. This method, however, not only requires labor and time, but is also sometimes unable to perfectly prevent the aforementioned drawbacks, thus presenting various problems in coating operation.

The present inventors have drawn their attention to the fact that the hydrolysis and dehydrocondensation of the alkyl silicate are conspicuously promoted in the co-presence of water and a basic substance. In view of this fact, they have found that when a coated film of the alkyl silicate type zinc rich paint is treated with an aqueous liquid containing a basic substance, the curing of the coated film is highly promoted and the curing time markedly shortened, and that when a water paint containing a basic substance is used, cracks never occur in a coated film of the alkyl silicate type zinc rich paint, even when the thickness of the coated film is large; consequently, the use will become possible of the alkyl silicate type zinc rich paint on a continuous mass-production line system. These findings have led the present inventors to complete the present invention.

According to the present invention, there is provided a process for curing a coated film of an alkyl silicate type zinc rich paint, which process comprises coating a substrate with the alkyl silicate type zinc rich paint, and then treating the resulting coated film with an aqueous liquid containing a basic substance, thereby to promote the curing of the coated film.

In the process of the present invention, the steps until the alkyl silicate type zinc rich paint is coated as a corrosion preventive paint on a substrate can be performed in the same manner as in an ordinary coating procedure. For instance, a substrate to be prevented from corrosion, e.g. a steel material, is derusted by blasting, and then coated with a shop primer for temporary rust prevention, and derusted again by blasting or power tool treatment prior to application of the alkyl silicate type zinc rich paint. Alternatively, the substrate is derusted in the above manner with said coating of the shop primer omitted, and then the derusted substrate is coated with the alkyl silicate type zinc rich paint.

In order for the alkyl silicate type zinc rich paint as a corrosion preventive paint to maintain its corrosion preventive effect for a long period of time, it is advantageous that the paint be coated to a dry film thickness of at least 30μ, preferably from about 60 to about 140μ, and more preferably from about 75 to about 100μ. This advantageous coating can be carried out by various known means such as airless spraying, air spraying or brushing.

The alkyl silicate type zinc rich paint usable in the present invention includes a rust preventive paint having a fundamental composition comprising a solution of an alkyl silicate, which is convertible into a silanol upon hydrolysis, (a silicic acid alkyl ester) dissolved in an easily volatile organic solvent capable of dissolving the alkyl silicate, said solution having zinc powder dispersed therein. Usually, the alkyl silicate type zinc rich paint comprises a two-component system consisting of an alkyl silicate solution component (a base solution) and a zinc powder component (a curing agent), and both components are mixed together immediately prior to the use of the paint. The hydrolyzable alkyl silicate is suitably the one containing an alkyl ester residue having not more than 8 carbon atoms, preferably not more than 4 carbon atoms, its examples including methyl silicate, ethyl silicate, propyl silicate, isopropyl silicate, butyl silicate and isobutyl silicate. Examples of the organic solvent capable of dissolving these silicic acid esters are alcohols (e.g. methanol, ethanol, propanol and isopropanol), ethers (e.g. ethylene glycol monoethyl ether), and esters (e.g. ethylene glycol monoethyl ether acetate, and 3-methoxybutyl acetate). The concentration of the silicic acid ester in the solution is not to be strictly controlled, but can be varied widely according to the type of the silicic acid ester, the type of the solvent used, and so forth. Generally, the concentrations may be 25 to 45% (w/v), preferably about 30 to 40% (w/v). The zinc powder to be dispersed in the alkyl silicate solution is advantageously the one having an average particle size of not more than 15μ, preferably not more than 10μ. The zinc powder is incorporated into the solution in a high concentration of at least 60% by weight, preferably from 65 to 90% by weight, more preferably from 70 to 85% by weight, on a dry film basis.

A filler such as talc, clay, mica, glass flake, calcium carbonate, baryta, bentonite or silica powder, and a pigment such as red iron oxide, zinc oxide, cyanine blue or cyanine green may be further incorporated in ordinary amounts into the alkyl silicate type zinc rich paint having the above-described fundamental composition.

A coated film of the alkyl silicate type zinc rich paint coated to the desired thickness is treated with an aqueous liquid containing a basic substance in accordance with the process of the present invention after at least part of the solvent has been volatilized.

The basic substance to be contained in the aqueous liquid may be any water-soluble inorganic or organic base which has a solubility in water of at least 10% (w/v), preferably at least 50% (w/v), at 25° C. Examples of the inorganic base include alkali metal hydroxides such as potassium hydroxide or sodium hydroxide; alkali metal carbonates such as potassium carbonate or sodium carbonate; bicarbonates such as sodium bicarbonate; and ammonium. Examples of the organic base include water-soluble organic amines such as ethylamine, propylamine, butylamine, allylamine, cyclohexylamine, diethylamine, diethanolamine, triethylamine or pyridine; water-soluble amino-terminated polyamides obtained by the condensation of dicarboxylic acids such as phthalic acid or adipic acid with diamines such as ethylenediamine or hexamethylenediamine; and organic quaternary ammonium salts such as tetraethanolammonium chloride. Of these basic substances, the water-soluble organic amines are preferred in the present invention. The basic substances listed here can be used singly or in combination of two or more.

The basic substance preferably usable in the present invention should desirably have a pKa value of 8 to 13, preferably 9 to 11. Particularly advantageous as such basic substance is a water-soluble amine of the formula

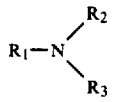

(I)

wherein $R_1$, $R_2$ and $R_3$ each represent a hydrogen atom, an alkyl group having 1 to 5 carbon atoms, an alkenyl group having 2 to 5 carbon atoms, a cycloalkyl group having 5 to 7 carbon atoms or a hydroalkyl group having 1 to 5 carbon atoms, with the proviso that $R_1$, $R_2$ and $R_3$ do not represent a hydrogen atom at the same time; or at least two of $R_1$, $R_2$ and $R_3$ may, together with the nitrogen atom to which they are bonded, form a 5- or 6-membered nitrogen-containing heterocyclic ring such as pyridine, piperidine or pyrrolidine.

The concentration of said basic substance in the aqueous liquid is not critical and can be varied widely according to the type of the basic substance, and so forth. Generally, that concentration is at least 10% by weight, preferably 20 to 70% by weight, more preferably 30 to 60% by weight, based on the weight of the aqueous liquid.

Said aqueous liquid can substantially comprise an aqueous solution of said basic substance. Also, organic thickening agents such as polyvinyl alcohol, polyvinyl methyl ether or methylcellulose; or inorganic thickening agents such as silica, activated clay or bentonite can be incorporated into said aqueous solution in order to adjust the viscosity of the aqueous solution. Water-miscible organic solvents such as alcohols may also be added to the aqueous solution.

Alternatively, the aqueous liquid can be in the form of a water paint containing the above-mentioned basic substance. That is, the basic substance can be incorporated into an ordinary water-soluble or water-dispersible type water paint.

A vehicle resin usable in the water-soluble type water paint includes, for example, an acrylic resin, an alkyd resin, and a polyester resin. Specific examples include carboxyl-containing alkyd resins; carboxyl-terminated polyester resins; carboxyl-containing acrylic resins; and resin modified with acids such as maleic acid or fumaric acid (e.g. coumarone resins or petroleum resins which have been modified with maleic acid or fumaric acid and into which a carboxyl group has been introduced). These resins can be used singly or in combination of two or more after they have been converted into water-soluble salts with the aforementioned basic substance.

The resin thus turned into a water-soluble salt can be made into the basic substance-containing water paint of the present invention by dissolving it in an aqueous medium as it is. If desired, the basic substance may be incorporated additionally. In this case, the total amount of the basic substance used for the formation of the water-soluble salt and said additional basic substance should be made to coincide with the aforementioned concentration.

A resin emulsion usable in the water paint of the water-dispersible type includes, for example, an oxidation-curable emulsion and an epoxy emulsion. Examples of the oxidation-curable emulsion include vinyl polymer emulsions obtained by emulsion-polymerizing polymerizable vinyl monomers (e.g. styrene, an acrylic ester and a methacrylic ester) with the use as emulsifiers of maleinized oils, maleinized alkyd resins, maleinized polybutadienes, and maleinized fatty acid-modified acrylic resins. There can also be used alkyd resin emulsions emulsified with ordinary surfactants, and emulsions obtained by further polymerizing said alkyd resin emulsions mixed with styrene, acrylic esters or methacrylic esters.

The aforementioned basic substance can be blended in the aforementioned concentration with the above-described oxidation-curable emulsion.

Examples of the epoxy emulsion include two-pack emulsions comprising epoxy resins containing at least two oxirane or epoxy groups in the molecule (e.g. epichlorohydrin/bisphenol A polycondensate system), said epoxy resins being emulsified with surfactants, and curing agents (e.g. water-soluble amines and water-soluble polyamide resins) to be added immediately before use.

When a water-soluble amine or a water-soluble polyamide resin is used as a curing agent in the epoxy emulsion, the water-soluble amine or water-soluble polyamide resin not only serves as a curing agent but also plays a role as the basic substance in accordance with the present invention. Therefore, when a water-soluble amine or a water-soluble polyamide resin is used as a curing agent, there is no need to use a basic substance, but of course, another basic substance may be employed in the aforementioned concentration.

Diluent for the water-soluble resin paint is usually water, but it is also possible and preferred to jointly use a small amount (preferably up to 5% v/v) of a hydrophilic solvent such as ethyl alcohol, isopropyl alcohol, butyl alcohol, Cellosolve or butyl Cellosolve.

As is usually practised, the following materials can be added, where necessary, in ordinary amounts to the water paint: Fillers such as talc, clay, mica, glass flake, calcium carbonate, baryta, bentonite or silica powder; pigments such as red iron oxide, zinc oxide, or cyanine blue; pollution-free rust preventive pigments such as aluminum phosphate, zinc phosphate, zinc polyphosphate, or zinc calcium cyanamide; defoaming agents such as polyethylene glycol-modified silicone resins; anti-settling agents such as isobutylene-maleic acid copolymer, or amide resins; and emulsifiers such as citric acid, or nonionic surface active agents. The amounts of these materials added are as shown in the Examples given later.

Treatment of a coated film of the alkyl silicate type zinc rich paint with the basic substance-containing aqueous liquid described above can be performed, for example, by coating the aqueous liquid on the coated film by a customary method such as airless spraying, air spraying or brushing; or by dipping in the aqueous liquid an article coated with the alkyl silicate type zinc rich paint. The pickup of the basic substance-containing aqueous liquid in this case can be varied widely according to the type and concentration of the basic substance used. Preferably, the pickup is at least 0.1 g, more preferably 1 to 30 g, most preferably 2 to 15 g, based on the weight of the basic substance in the aqueous liquid, per square meter of the coated film of the alkyl silicate type zinc rich paint.

The coated film thus treated with the basic substance-containing aqueous liquid can then be dried and cured. This drying and curing step can be carried out at ordinary temperature or under heat of up to about 100° C. At the ordinary temperature, the step can be completed in about 1 to 4 hours; under heat of about 80° to 100° C., it can be completed in about 10 to 15 minutes. The drying and curing step can be performed, for example, by means of an ordinary infrared oven, far-infrared oven, or hot-air oven. During the course of, or after completion of, the drying and curing step, the coated film can be neutralized with an acid aqueous solution and/or washed with water.

Further, if desired, a top coat paint such as an epoxy paint, an epoxy tar paint, a chlorinated rubber paint, an alkyd paint or emulsion paints of various types can be applied, as in customary practice, onto the cured film of the alkyl silicate type zinc rich paint treated with the basic substance-containing aqueous liquid in accordance with the present invention.

According to the process of the present invention that has been so far described, the basic substance-containing aqueous liquid penetrates the coated film of the alkyl silicate type zinc rich paint, promoting the hydrolysis of the alkyl silicate, and/or the formation of polysiloxane upon dehydrocondensation of silanol formed, or a polymer crosslinking reaction through the reaction of the silanol and/or polysiloxane with zinc powder. For instance, the curing of a coated film for which conventional methods have required at ordinary temperatures a time as long as about 24 to 48 hours to complete can be effected by the process of the present invention in about 1 to 4 hours. Under the heat-curing conditions at about 80° to 100° C., the process of the present invention has the ability to complete curing in a time as short as about a hundredth to a two-hundredth of the period of time required of the conventional methods. As noted from this, the process of the present invention markedly promotes the drying and curing of a coated film of the alkyl silicate type zinc rich paint and shortens the time required for the coating step, thus making possible the hitherto unachievable introduction of a rust preventive coating step using the alkyl silicate type zinc rich paint into a continuous mass-production line.

Furthermore, the process of the present invention enables the alkyl silicate type zinc rich paint to be coated thick. According to the conventional methods, cracking occurred in a coated film when its dry thickness was 140μ or more, and it was impossible to give a coated film having a large thickness. With the process of the present invention, the paint can be coated up to a dry film thickness of about 300μ without cracking of the film. In contrast to the fact that the formation of a coated film having a large thickness of 140μ or more has hitherto necessitated the coating of the paint its one layer on another, the process of the present invention can save labor for such lay-up coating, thus making the shortening of overall procedure possible.

The process of the present invention, moreover, enables the long-term corrosion preventive properties of the alkyl silicate type zinc rich paint to be improved further, and when the basic substance-containing aqueous liquid of the water paint type is used, the treatment with the aqueous liquid can eliminate irregularities and holes formed on the surface of a coated layer of the alkyl silicate type zinc rich paint, thereby preventing pinholes, craters, rough surface and the like to be caused to a top coat.

The present invention will be described in greater detail by reference to the Examples and Comparative Examples below.

EXAMPLE 1

Mill scale, red rust, etc. on the surfaces of a steel plate were removed by shot blasting (the degree of the treatment: Sa 2½ or more by Swedish Standard). The shot-blasted steel plate was coated with an alkyl silicate type zinc rich paint (I) having the following composition (SD zinc primer ZE 1500, a product of Kansai Paint Co., Ltd.) by airless spraying so that its dry film thickness became 75μ. The coated plate was dried at 50° C. for 10 minutes or at ordinary temperature for 30 minutes, and then coated with a curing promoter of the following composition by air spraying to a thickness of 5μ, followed by drying at 80° C. for 10 minutes or at ordinary temperature for 60 minutes. Then, the resulting coated film was neutralized with a 1% phosphoric acid aqueous solution, washed with water, drained and dried at 100° C. for 10 minutes or at ordinary temperature for 3 hours, and then examined for film properties. The results are shown in Table 1 below.

| Composition of the alkyl silicate type zinc rich paint (I): | | |
|---|---|---|
| Solution (base): | | |
| Ethyl silicate | 5.5 | parts by weight |
| Bentonite | 3.5 | parts by weight |
| Isopropyl alcohol | 8.0 | parts by weight |
| Ethylene glycol monoethyl ether acetate | 8.0 | parts by weight |
| Total | 25 | parts by weight |

-continued

| Composition of the alkyl silicate type zinc rich paint (I): | | |
|---|---|---|
| Curing agent: | | |
| Zinc powder (average particle size: 3μ) | 65 | parts by weight |
| Silica powder (average particle size) | 10 | parts by weight |
| Total | 75 | parts by weight |
| Formulation of the curing promotor: | | |
| Diethanolamine | 60 | parts by weight |
| Tap water | 40 | parts by weight |
| Finely divided silica | 3 | parts by weight |
| Total | 103 | parts by weight |

EXAMPLE 2

A shot-blasted steel plate as employed in Example 1 was coated with an alkyl silicate type zinc rich paint (II) of the following composition (SD zinc primer ZE 1500 N, a product of Kansai Paint Co., Ltd.) in the same manner as in Example 1, and then dried at 50° C. for 10 minutes or at ordinary temperature for 30 minutes. The plate was then coated with an epoxy emulsion paint of the following formulation by air spraying to a thickness of 125μ. The coated plate was dried at 100° C. for 15 minutes or at ordinary temperature for 16 hours, and then examined for film properties. The results are listed in Table 1.

| Composition of the alkyl silicate type zinc Rich paint (II): | | |
|---|---|---|
| Base (solution): | | |
| Ethyl silicate | 9.5 | parts by weight |
| Bentonite | 0.4 | parts by weight |
| Red iron oxide | 0.6 | parts by weight |
| Talc | 7.5 | parts by weight |
| Isopropyl alcohol | 6 | parts by weight |
| Cellosolve acetate | 6 | parts by weight |
| Total | 30 | parts by weight |
| Curing agent: | | |
| Zinc powder (average particle size: 3μ) | 60 | parts by weight |
| Baryta (average particle size: 5μ) | 10 | parts by weight |
| Total | 70 | parts by weight |

Formulation of the epoxy emulsion paint

The epoxy emulsion paint was prepared by mixing a base of the following composition and a curing agent of the following composition immediately prior to its use. Epicure 4255 in the curing agent acts not only as a curing agent for Epikote DX-255 but also as a basic substance in accordance with the present invention.

| | | |
|---|---|---|
| (Base) | | |
| Epikote DX-255 (a product of Shell Chemicals.) | 25.0 | parts by weight |
| Red iron oxide | 4.0 | parts by weight |
| Aluminum phosphate | 10.0 | parts by weight |
| Clay | 10.0 | parts by weight |
| Talc | 3.5 | parts by weight |
| Mica | 3.5 | parts by weight |
| 50% Aqueous solution of citric acid | 0.3 | parts by weight |
| Emulsifier (Adekanol, a product of Asahi Denka Kogyo K.K.) | 3.0 | parts by weight |
| Anti-settling agent (Thixol K130B, a product of Kyoei Oil Chemical Co., Ltd.) | 0.7 | parts by weight |
| Tap water | 20.0 | parts by weight |
| Total | 80.0 | parts by weight |
| (Curing agent) | | |
| Epicure 4255, a product of Shell Chemicals., composed mainly of a polyamide compound) | 15.0 | parts by weight |
| Tap water | 5.0 | parts by weight |
| Total | 20.0 | parts by weight |

EXAMPLE 3

A shot-blasted steel plate as employed in Example 1 was coated with the same alkyl silicate type zinc rich paint as employed in Example 1 by the same method as in Example 1. Then, the coated plate was dried at 50° C. for 10 minutes or at ordinary temperature for 30 minutes. Then, an acrylic emulsion paint of the following composition was coated on the plate to a thickness of 30μ by air spraying. The coated plate was dried at 100° C. for 15 minutes or at ordinary temperature for 16 hours. Then, an epoxy ester type paint (Epomarine, a product of Kansai Paint Co., Ltd.) was coated as a top coat paint on the plate by airless spraying so that a dry film thickness became 40μ. The coating was dried at 80° C. for 10 minutes or at ordinary temperature for 16 hours, and examined for coated film properties. The results are shown in Table 1.

| Composition of the acrylic emulsion paint: | | |
|---|---|---|
| Maleinized acrylic resin (acid value: 70, number average molecular weight: 1000-2000) | 27.0 | parts by weight |
| Triethylamine | 3.0 | parts by weight |
| Talc | 3.0 | parts by weight |
| Calcium carbonate | 11.0 | parts by weight |
| Zinc white | 6.0 | parts by weight |
| Red iron oxide | 6.5 | parts by weight |
| Defoaming agent (Flownon SB210, a product of Thoshin Chemical Co., Ltd.) | 0.5 | parts by weight |
| Anti-settling agent (Thixol W300, a product of Kyoei Oil Chemical Co., Ltd.) | 8.0 | parts by weight |
| Tap water | 35.0 | parts by weight |
| Total | 100.0 | parts by weight |

COMPARATIVE EXAMPLE 1

A shot-blasted steel plate as employed in Example 1 was coated with the same alkyl silicate type zinc rich paint (I) as used in Example 1 in the same manner as in Example 1. After the coating was dried at ordinary temperature for 48 hours or at ordinary temperature for 72 hours, the properties of the coated film are examined. The results are tabulated in Table 1.

COMPARATIVE EXAMPLE 2

A shot-blasted steel plate as employed in Example 1 was coated with the same alkyl silicate type zinc rich paint (II) as used in Example 2 in the same manner as in Example 1. After the coated plate was dried at ordinary temperature for 24 hours, it was further coated with an epoxy paint (Epomarine Paint HS, a product of Kansai Paint Co., Ltd.) by airless spraying so that a dry film having a thickness of 125μ was formed. After drying at ordinary temperature for 16 hours, the film was examined for properties. The results are shown in Table 1.

COMPARATIVE EXAMPLE 3

A shot-blasted steel plate as employed in Example 1 was coated with the same alkyl silicate type zinc rich paint as used in Example 1 by the same method as in Example 1. After the coated plate was dried at ordinary temperature for 24 hours, an epoxy ester paint (Epomarine EE primer, a product of Kansai Paint Co., Ltd.) was coated thereon as in intercoat paint by airless spraying so that its dry film thickness became 40μ. After the coating was dried at ordinary temperature for 16 hours, an epoxy ester paint (Epomarine EE, a product of Kansai Paint Co., Ltd.) was applied thereon by airless spraying so that its dry film thickness became 40μ. The film was dried at ordinary temperature for 16 hours, and then its properties were examined. The results are shown in Table 1.

EXAMPLE 4

A shot-blasted steel plate as employed in Example 1 was coated with the same alkyl silicate type zinc rich paint as used in Example 1 by the same method as in Example 1. Then, the coated plate was dried at 50° C. for 10 minutes or at ordinary temperature for 30 minutes. Then, an acrylic styrene paint of the following composition was coated on the plate by air spraying to a thickness of 30μ, and dried at 100° C. for 15 minutes or at ordinary temperature for 16 hours. Then, an alkyd paint (Neo Ftalit, a product of Kansai Paint Co., Ltd.) was coated as a top coat paint on the dried coating by airless spraying so that its dry film thickness became 40μ. The coating was dried at 80° C. for 10 minutes or at ordinary temperature for 16 hours, and the properties of the resulting film were examined. The results are listed in Table 1.

| Composition of the acrylic styrene paint: | | |
|---|---|---|
| Acrylic styrene emulsion (Boncoat EC-710, a product of Dainippon Ink And Chemicals, Inc.) | 560 | parts by weight |
| Water-soluble alkyl resin varnish (66%) (Water Sol S-312, a product of Dainippon Ink And Chemicals, Inc.) | 55.5 | parts by weight |
| Red iron oxide | 50.0 | parts by weight |
| Potassium phosphate | 75 | parts by weight |
| Talc | 55 | parts by weight |
| Cobalt naphthenate (5% cobalt) | 0.5 | parts by weight |
| Tap water | 70 | parts by weight |
| Ethylene glycol monobutyl ether | 10 | parts by weight |

-continued

| Composition of the acrylic styrene paint: | | |
|---|---|---|
| 2-Amino-2-methylpropanol | 4.5 | parts by weight |
| Defoaming agent (1202 NDW, a product of Sunnopco) | 4 | parts by weight |
| Total | 884.5 | parts by weight |

EXAMPLE 5

A shot-blasted steel plate as employed in Example 1 was coated with the same alkyl silicate type zinc rich paint as used in Example 1 in the same manner as in Example 1. Then, the coated plate was dried at 50° C. for 10 minutes or at ordinary temperature for 30 minutes. Then, a water-soluble resin paint of the following composition was coated on the plate by air spraying to a thickness of 30μ, and dried at 100° C. for 15 minutes or at ordinary temperature for 16 hours. Thereafter, an emulsion paint (Viny Deluxe, a product of Kansai Paint Co., Ltd.) was coated as a top coat paint on the coating by airless spraying so that its dry film thickness became 40μ. The coating was dried at 80° C. for 10 minutes or at ordinary temperature for 16 hours, and the properties of the resulting film were examined. The results are shown in Table 1.

| Composition of the water-soluble resin paint: | | |
|---|---|---|
| Water-soluble resin (I)*1 | 9 | parts by weight |
| Oxidative-polymerizable emulsion (II)*2 | 45 | parts by weight |
| Talc | 3 | parts by weight |
| Calcium carbonate | 11 | parts by weight |
| Zinc White | 6 | parts by weight |
| Red iron oxide | 7 | parts by weight |
| Ethylene glycol monobutyl ether | 3 | parts by weight |
| Triethylamine | 1 | parts by weight |
| Tap water | 13.3 | parts by weight |
| Cobalt naphthenate (5% cobalt) | 0.3 | parts by weight |
| Lead naphthenate (15% lead) | 0.9 | parts by weight |
| Thickening agent (Thixol W300, a product of Kyoei Oil Chemical Co., Ltd.) | 8 | parts by weight |
| Defoaming agent (Flownon, a product of Kyoei Oil Chemical Co., Ltd.) | 0.5 | parts by weight |
| Total | 108.0 | parts by weight |

*1Maleinized product of a fatty acid-esterified copolymer of styrene and allyl alcohol; acid value 90, number average molecular weight 1000–2000.

*2Emulsion obtained by emulsion-polymerizing a polymerizable vinyl monomer with the use as an emulsifier of said water-soluble resin (I) that has been neutralized.

TABLE 1

| Example No. | Degree of curing and drying of coated film of alkyl silicate type zinc rich paint[a] | Condition of coated film[b] | Adhesion of coated film[c] | Corrosion preventive property[d] Dipped in sea-water | Corrosion preventive property[d] Exposed out-doors |
|---|---|---|---|---|---|
| Ex. 1 | F | Good | Good | Good | Good |
| Comp. Ex. 1 | B after 48 hours at ordinary temperature HB after 72 hours at ordinary temperature | Good | Good | Good | Good |
| Ex. 2 | H | 1 No cracking occurred when the dry film thickness of the alkyl silicate type zinc rich paint was 300 μ or more 2 No Pinhole formed after top coating | Good | Good | — |
| Ex. 3 | H | 1 No cracking occurred when the dry film thickness of | Good | — | Good |

TABLE 1-continued

| Example No. | Degree of curing and drying of coated film of alkyl silicate type zinc rich paint[a] | Condition of coated film[b] | Adhesion of coated film[c] | Corrosion preventive property[d] Dipped in sea-water | Corrosion preventive property[d] Exposed outdoors |
|---|---|---|---|---|---|
| | | the alkyl silicate type zinc rich paint was 300 μ or more 2 No pinhole formed after top coating | | | |
| Comp. Ex. 2 | 2B | 1 Cracking occurred when the dry film thickness of the alkyl silicate type zinc rich paint was 140 μ or more 2 Pinholes formed after top coating | Good | Good | — |
| Comp. Ex. 3 | 2B | 1 Cracking occurred when the dry film thickness of the alkyl silicate type zinc rich paint was 140 μ or more 2 Pinholes formed after top coating | Good | — | Good |
| Ex. 4 | H | Same as in Ex. 3 | Good | — | Good |
| Ex. 5 | H | Same as in Ex. 3 | Good | — | Good |

[a]Degree of curing and drying: The pencil hardness of the coated film of the alkyl silicate type zinc rich paint was measured. In the case of Exs. 2, 3, 4 and 5 and Comp. Exs. 2 and 3, the top coat was removed and the hardness of the coating of the alkyl silicate type zinc rich paint was measured.
[b]Condition of coated film: 1 The alkyl silicate type zinc rich paint was coated to a pre-determined film thickness of 75 μ or more, and the limit of the film thickness until which cracking did not occur was investigated. 2 It was observed whether or not pinholes formed when the top coat paint was coated.
[c]Adhesion of coated film: The test plate was dipped in seawater for 20 months or exposed outdoors for 20 months, and then subjected to a cross cut peeling test using a cellophane tape, to evaluate the adhesion.
[d]Corrosion preventive property: The test plate was given cross cuts reaching the substrate, and then dipped in seawater for 20 months or exposed outdoors for 20 months. After lapse of this period, the property was evaluated.

What is claimed is:

1. A process for curing a coated film of an alkyl silicate type zinc rich paint, which comprises coating a substrate with an alkyl silicate type zinc rich paint; treating the resulting coated film with a water-soluble type water paint containing a water-soluble basic substance and a vehicle resin selected from the group consisting of carboxyl-containing alkyd resins, carboxyl-terminated polyester resins, carboxyl-containing acrylic resins and coumarone resins or petroleum resins into which a carboxyl group has been introduced, or a water-dispersible type water paint containing a water-soluble basic substance and an oxidation-curable emulsion, an epoxy emulsion or an alkyd resin emulsion, and then drying and curing the resulting coated film at ordinary temperatures or under heating, up to about 100° C.

2. A process as described in claim 1 wherein said aqueous liquid consists principally of an aqueous solution.

3. A process as described in claim 1 wherein the solubility in water of said basic substance is at least 10% (w/v) at 25° C.

4. A process as described in claim 1 wherein said basic substance has a pKa value in the range of 8 to 13.

5. A process as described in claim 1 wherein said basic substance is a water-soluble organic amine.

6. A process as described in claim 1 wherein said aqueous liquid contains 20 to 70% by weight of said basic substance.

7. A process as described in claim 1 wherein said aqueous liquid is coated in an amount of at least 0.1 g, based on the weight of the basic substance contained in said aqueous liquid, per square meter of the coated film of the alkyl silicate type zinc rich paint.

8. A process as described in claim 7 wherein said aqueous liquid is coated in an amount of 1 to 30 g, based on the weight of the basic substance in the aqueous liquid, per square meter of the coated film of the alkyl silicate type zinc rich paint.

9. The process as described in claim 1 wherein said oxidation-curable emulsion is a vinyl polymer emulsion obtained by emulsion-polymerizing a polymerizable vinyl monomer in the presence of an emulsifier selected from maleinized oils, maleinized alkyd resins, maleinized polybutadienes, and maleinized fatty acid-modified acrylic resins.

10. The process as described in claim 9 wherein said vinyl monomer is selected from the group consisting of styrene, acrylic ester and methacrylic esters.

* * * * *